US005590616A

United States Patent [19]

Vera

[11] Patent Number: 5,590,616

[45] Date of Patent: Jan. 7, 1997

[54] SURF-BOAT

[76] Inventor: Daniel Vera, 4322 Driftwood, Corpus Christi, Tex. 78411

[21] Appl. No.: 369,472

[22] Filed: Jan. 6, 1995

[51] Int. Cl.[6] ..... B63B 1/10

[52] U.S. Cl. ..... 114/61; 114/261; 114/361

[58] Field of Search ..... 114/61, 261, 248, 114/361, 265

[56] References Cited

U.S. PATENT DOCUMENTS

| | | | |
|---|---|---|---|
| 2,804,038 | 8/1957 | Barkla | 114/61 |
| 3,273,526 | 9/1966 | Glosten | 114/265 |
| 3,548,770 | 12/1970 | Boutros | 114/265 |
| 3,659,546 | 5/1972 | Miklos | 114/248 |

FOREIGN PATENT DOCUMENTS

| | | | |
|---|---|---|---|
| 2678232 | 12/1992 | France | 114/61 |

*Primary Examiner*—Sherman Basinger

[57] ABSTRACT

A surf-boat for travelling or standing on choppy waters, such as may be encountered in gulfs, bays, surfs and beach fronts is provided, typically having three pontoons, three columns and two concentrically aligned decks; an upper deck and a lower deck, wherein the benefits over typical single hull and multi hull and other prior art pontoon configurations, lies in the fact that the pontoons of the present invention are designed to plow-through a wave such as may be encountered in waters described as "choppy" resulting in limited wave response of the entire boat and a much smoother and a less motion-response-to-waves ride by persons on the boat. Other equally important features are that the main surface for people to stand on the boat is flat and the craft may be used as a stable observation or camera platform for observing and recording of watersports and marine life, and as an offshore rest and first aid station for boaters and windsurfers. The craft is also a good fishing platform which has the advantage, over small boats, of elevating the fisherman's viewpoint of the water, so that the angle of light reflection from the water surface up to about one hundred yards away, is significantly less acute and therefor less glaring to the fisherman's eyes. This also permits a better view of the immediately surrounding area below the water's surface.

The surf-boat when assembled resembles a three legged oil well drilling platform with the exception that the legs or columns are configured so that their stance, that is the distance between any two pontoon centers, is greater than the distance from the top side of the upper platform to the water surface. The pontoons may be either ballasted or are fitted with sub surface hydro-foils or a combination of the two in order to minimize the craft's buoyancy and/or responsiveness to wave action. The craft may be motorized or not and may have an engine-well centrally located on said lower platform for added stability. The craft may be fitted with a foot operated propeller and a removable semi-rigid flat weather shade which is sturdy enough to allow a 350 pound person to stand on top and use it as a diving platform or elevated observation deck, or sail.

7 Claims, 8 Drawing Sheets

FIG. 6
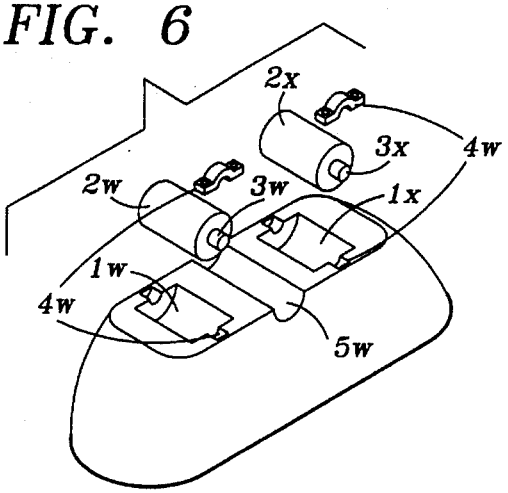
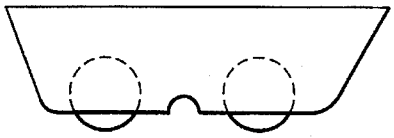
FIG. 7
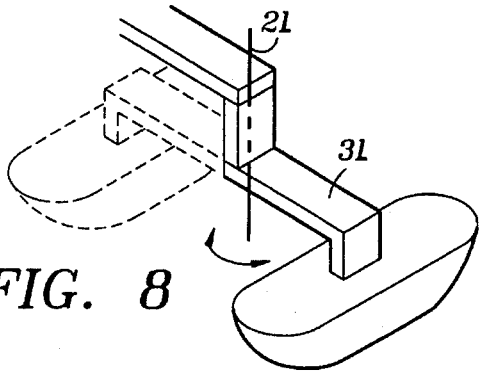
FIG. 8
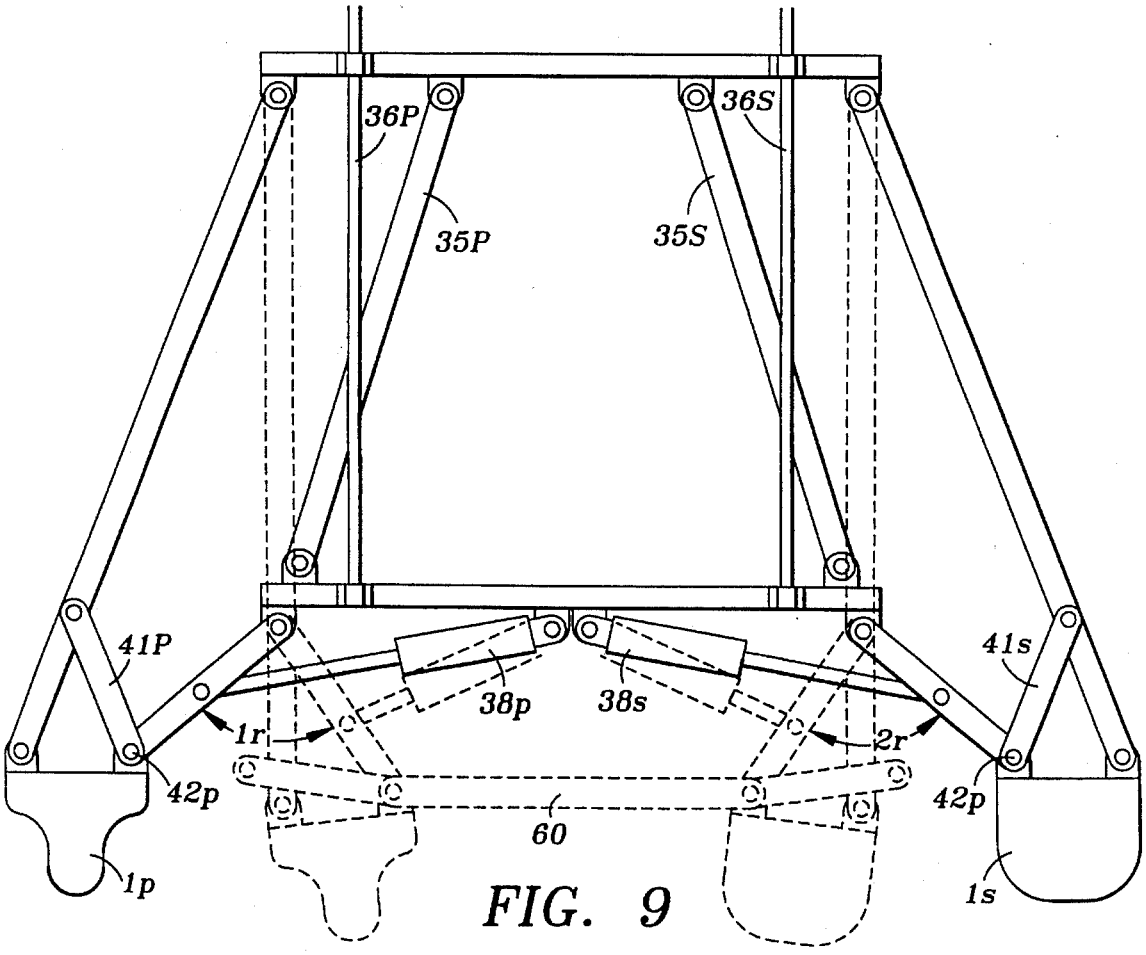
FIG. 9

SURF-BOAT

BRIEF SUMMARY OF INVENTION

This invention relates to a water-going craft, primarily designed for private ownership and home storage and for use especially in surf waters or waters which are frequently rough having choppy waves or other turbulence in the waters surface and also for situations requiring low draft boats, however industrial and atypical designs are also included and claimed. Generally, the craft comprises one or two or more platforms or decks and at least three pontoons and at least three columns, each column being at least one foot in height and having top and bottom ends and a midway point. The craft also has means for connecting the pontoons to the platforms such as pivot pins. In one of the best embodiments two platforms are used, the platforms which may also be referred to as decks are positioned one above the other each in a horizontal plane. As such they would comprise an upper and a lower deck each being generally flat or planar and roughly triangular in shape and having top and under sides and port and starboard and tail edges and a leading point and means for adjustably fixing the platforms to the columns. These platforms are held in nearly concentric alignment, with the exception that the lower platform may be longer than the upper platform, and they are separated from each other by being adjustably or permanently fixed to the columns. The columns, one forward and two aft generally, further comprise means for attaching said column bottom ends to said pontoons. In some applications the two parallel aft pontoons may be designed to be the forward part of the craft. The pontoons are roughly elongated rectangular cubes, but may be cylindrical or other shapes which generally provide flotation and wave permeability, have tapered sides, and tapered leading and trailing ends and are generally designed to allow water to easily flow around and under the pontoons from any direction that the water or wave may be approaching from. This effect is sometimes referred to herein as wave response or wave permeability or a measure thereof; wherein, high wave permeability, would be used to refer to a floating object shape which when supporting weight would be less disturbed by wave action than something with low wave permeability and like wise high wave response or responsiveness would indicate an opposite measure e.g. high wave responsiveness, would be used in reference to an object which would be greatly disturbed by relatively little wave action. The pontoons may have a flat top or they may be cylindrically shaped, and they may sometimes be pivotable and/or rotatable in order to change the amount of water drafted by the pontoons and to allow for the crafts wave response to also be changed. The pontoons keep the rest of the structure above water and afloat. They support the columns and the columns support the deck or decks and shade. In the primary embodiment, viewed from above, the pontoons are laid out in either an equilateral or an isosceles triangular configuration and the platforms are also equilateral or isosceles triangles all facing the same directional orientation. Thus there is a leading or forward pontoon which is connected to the two platforms via a column and there are two similar pontoon, column and deck configurations aft; one port and one starboard, connecting the rear corners of the platforms to the aft pontoons. The pontoons are distinctly separate and do not touch each other, and they are about equa-distant from each other. A significant feature of this invention is the alignment of the pontoons relative to the rear port and starboard or lateral sides of the decks of the craft. The aft pontoons, located at the rear of the craft are, when deployed, at their greatest width apart, are well more than twice the distance of the distance from the top of the upper deck to the bottom of the pontoons and likewise relative from the top deck to the waterline. At their narrowest points the rear pontoons are about twice the distance referred to above. Also the deck's width at the rear of the craft is half the distance of the pontoon spread and is centered between the aft pontoons. Thus where the deck is eight feet wide the approximately two foot wide pontoons are sixteen feet apart at their outsides and where the same deck is twelve feet long the distance from the rear of the aft pontoons to the front of the forward pontoon would be about twenty feet. Thus viewed from the rear the decks are suspended above and between the two rear pontoons. Viewed from either port or starboard side the decks appear to be directly above the forward half of the rear pontoons and above the rearward half of the forward pontoon. But, while the forward portion of the deck would be directly above the forward pontoon the deck would not be directly above the rear pontoons because the pontoons are outside of the decks width. The relatively flat platforms are suspended above the pontoons on columns or foldable or partially collapsible scaffolds which are typically positioned near the points of the triangularly shaped platforms and connect to the top surfaces of the pontoons roughly centered thereon. The columns may also be placed between the middle of the aft pontoons and their leading end thereon and they may all be adjustable to allow for special applications such as trailering needs or length and width limitations of other craft accommodations. The pontoons may of course also be situated completely outside all portions of the deck or decks.

The craft may be steered by several means: One good way to effect steering on tri-podded vehicles is to steer the forward pod, as in children's tricycles. One way that the forward pontoon may be steered is to pivotally attach it to the bottom of the forward column via a pivot pin and washers and universal joint and steering column housed within the forward column to a steering wheel or handle bar at the top of the steering column; allowing it to be steered in a generally horizontal plane. Another way to steer the craft is to steer a rudder located either or both fore and aft of the forward pontoon; yet another way is by combining pontoon steering with rudder steering. In this case one may also steer the craft by using a configuration of a steering column, cables and pulleys or hydraulic and/or pneumatic valves and cylinders or a combination thereof to pivot the forward pontoon. The craft is generally designed to travel relatively slowly when compared to power boats. However, it is also conceived that the craft may be designed to have hydrofoils and/or skis to allow for high speed travel and possibly even be able to fly. The craft may be provided with a shade made of a lightweight frame and a lightweight cloth or synthetic panel to serve the upper deck which shade may also be used as a sail by relocating it on the craft to propel the craft in emergencies or as recreation. Another way to steer the craft is to provide rudders to the aft pontoons and/or to pivotally mount the aft pontoons so that they may be steered either as a pair or simultaneously with the forward pontoon steering.

An equally important feature of the craft is that it may be configured so that the aft columns have the ability to contract and reduce the stance so that the craft may fit into boat slips and onto trailers which may be used to legally haul the craft on streets and highways on typical home stored boat trailers.

Background

Background Art: Pontoon boats and multi hull boats are known to exist in the prior art. All of the configurations known to this inventor involve either parallel juxtaposition of two or three elongated pontoons such as in catamarans and tri-marans which generally run the entire length of the craft's deck and are placed at the extreme port and starboard edges of the crafts with the exception that trimarans have an additional one in the middle running the length or more of the craft. While this tends to reduce wave action and streamline the craft for high speed travel the positions of the pontoons relative to the craft's center of gravity limits the height of the deck surface above the water or the pontoons water line; and it requires large size to be effective. One design has been put forth which is generally an outrigger design with a deck which is elevated that expands to the limit of the outrigger, this craft is so large that it is not trailerable and is not designed for home storage nor is it contractible. Water going floating tricycles are also known and their wheel could conceivably be used as the pontoons on the invention here presented. These tricycles generally have a much higher proportionate profile and high center of gravity and would not be useful in choppy water.

Distinction

The purpose of the craft of the present invention is to provide a cheaply built, trailerable and home storable, good wave action absorbing, also called wave permeable, stable elevated platform, that is supported by at least three pontoons, which floats on a body of water, and may be used for water recreation such as; fishing or observing sporting events or launching windsurfers, or conducting biology or marine biology research from its multi level venue from a relatively light weight water-craft which by virtue of its design also provides at least one shaded and stable deck and\or a platform which responds relatively little to the external forces of wave action when compared to currently designed V-hull boats and pontoon craft. Another use of the present invention is for military purposes such as a water-borne landing strip for aircraft; a decoy ship transporter; an observation post. The crafts pontoons may also be replaced with wheels and the entire craft driven as a giant three wheeled motorcycle. The present invention includes the use of pontoons which have high wave permeability and positioning well outside of the craft's deck. As such a leverage disadvantage to any waves acting as external forces to upset the stability of the craft is achieved. The craft also provides means for contracting its base to allow it to fit onto highway legal trailers and into narrow boat slips. Several shapes of pontoons besides the ones more fully described herein which may be used to advantage are: teardrop shape, capped end pipe segment shape mounted vertically or horizontally, up right or inverted dome shape, upright or inverted pyramid shape, giant rudder shape, fin shape, surfboard shape, and bundled log or pipe shaped. The craft provides means for propelling itself and has features such as air compressors and pneumatic slave cylinders for use in deploying and/or contracting the craft's pontoons and operating steering and other features. The pontoons may be ballasted, which ballast may also be pneumatically controlled. Similarly a hydraulic and/or pneumatic steering capability may be pneumatically powered or assisted.

Other Configurations and Variations

In one of the best practicable configurations, besides having the foregoing qualities, the pontoons, are made of fiberglass shells which are filled with polyurethane foam as a stiffener or other floatation filler such as polystyrene, or both polystyrene and polyurethane; and reinforcing structure within and each have enough buoyancy to float the combined weight of said pontoon and, DEPENDING on the overall size of the craft from about one hundred fifty to several thousand pounds extra and each platform also has an identical or similar surplus buoyancy. One or all of the pontoons may have a storage compartment for storing compressed air or fuel or water or waste toilet water and the pontoons may be expandable. The platforms are comprised of foam filled fiber glass reinforced plastic housings, similar to the pontoon construction, with bracing inside the housing which provides a relatively thin and stiff platform which will support at least about one hundred fifty pounds per square foot and which will be from one half inch to several feet thick and have a surface area of from ten to several hundred square feet. Each platform, is generally flat and may have floatation incorporated into it; also has a safety rail around the perimeter of the top sides of each platform so persons may hold onto it, and a surface which will allow for traction of people's shoes or feet when said surface is wet. Further, the top side of the upper platform is at least four feet above the water surface; but may be from one to several hundred feet above the water surface depending on the specific size of the base and/or craft and its pontoon stance in general. The under side of the top platform may also have a hand rail especially for use by wind surfers who may be using the craft as a base station. In such a configuration a wind surfer would be able to steer into the craft placing the nose of his surf board under the lower deck, between any two pontoons, then as he steps off the board and onto the lower deck he/she can grab hold of the hand rail that is on the underside of the top platform. The decks may be fitted with apparatus for gently holding windsurfboard's masts and booms. The craft may also have a collapsible multi function shade which can be used as a sail or as a third platform for use as an observation deck or as a diving platform for swimmers or hang-gliders.

In typical configuration the pontoons comprise one front and two aft pontoons and each have inboard and outboard edges and front and rear ends and top and bottom sides, said aft pontoons inboard edges are set at least, but preferably at a greater distance to each other than the distance from the top side of the upper platform to the water surface and the distance between the rear end of the front pontoon and the front ends of the aft pontoons is also at least but preferably greater than the distance from the top side of the upper pontoon to the water surface.

Another atypical configuration would be as a portable airplane runway or landing strip on water. In this configuration the craft is designed as a long strip about from fifteen to about fifty feet wide having curbs to keep an aircraft's landing gear from slipping off and falling into the water and perhaps also having several groves along the length of the runway to help align the craft as it lands on the runway and several hundred feet long with a plurality of extended pontoons around the entire landing strip's perimeter or perhaps just along the port and starboard sides, supporting the runway ballasted for stability. Should the airplane land to one side or the other or come to rest on one side or the other, the pontoons could be designed to have a medium or high wave responsiveness so that an aircraft landing on the surface would not be able to cause the runway to list or tilt because of the leverage disadvantage the craft would have on the pontoon which in this example would be extended at least an additional one fourth to one half the width of the runway away from the runway along its length and width. From the a high above view it may appear as a runway being supported on an exaggerated large railroad track having pontoons along the edge of the track. Once the aircraft was down and secured to the runway the pontoons could be de-ballasted and the aircraft could provide propulsion by running its propeller or jet engine. Even a segment of the runway perhaps underneath where the aircraft comes to rest could be removed from the rest of the runway and be used as a separate floatation platform. As such it would have a very low profile and be towable in a contracted form, possibly even rolled up like a carpet or folded like a folding scaffold/ladder, behind military or non military vessels which would otherwise be of little or no use to aircraft.

Another configuration may be as a main craft having square or any geometrical shape and also having floating boat moorings attached wherein in emergency situations several boats could tie to it and compliment their high sea survivability thereby. Such a configuration may include within the main craft all of the amenities of a convenience store and first aid station and/or living quarters.

Referring to the primary configuration, propulsion of the craft on water may be accomplished in several ways: by centrally locating an outboard motor on a jack plate on the lower deck stability is enhanced and propulsion would effectively be thus provided; using a remote controlled tethered tug craft such as a Jet Ski propulsion or at least motored mobility might also be thus provided; Propulsion could also be effected via rearward mounted and rearward facing air boat propellers mounted either between decks or on the aft pontoons; foot pedal operated water propellers or a paddle wheel may also provide propulsion and low or non impact exercise for the passengers; finally, the craft, because of its relatively flat solid deck surfaces, the lower deck may be fitted with a permanent or a temporarily deployable, hover craft air-bubble-envelope such as a farm tractor tire inner-tube fastened to the under side of the lower deck and the lower deck may be fitted with suitable air fan for providing lift to the craft by being enabled to blow air downward into the center of the air bubble envelope and any of the foregoing propulsion means employed for laterally moving the craft on water and even possibly on land; similarly air buoyancy may be provided to the under sides of the individual pontoons. Flaps extended from below the lowest deck to near the water surface or from pontoon to pontoon may also be employed to effect a hovercraft air bubble.

The platforms may be connected to each other by means other than the legs which connect the pontoons to the craft, such as: walls or columns or poles that are independent of the legs or a frame such as a scaffold frame. Basically four general sizes of surf-boats are considered and they range in capacity of; a one person one deck craft, a one to ten person two deck craft, thirdly a commercial craft which could accommodate a typical convenience store, housing therein also an emergency medical facility, floating boat dock and a fueling station, an off shore helicopter landing pad which could be quickly deployed to an area via a cargo plane or another water craft or by its own propulsion. Finally an ocean going commercial size is conceived having a water clearance (the distance from the underside of the lowest deck to the water surface) of from about ten feet to one hundred feet and a total height of about up to three hundred feet with multiple decks and partial decks which would house off-shore business offices and most if not all of the amenities of an office building. Intermediate sizes of craft are obvious variations of this disclosure; as would be increasing the number of pontoons or the geometric shape of the deck or decks. Propulsion motors and\or propellers or paddle wheels may also be affixed to either the lead pontoon or to the two aft pontoons or both the lead and aft pontoons.

An atypical configuration would be especially useful in military situations wherein one or all of the decks also act as air foils and the craft may either be towed into flight or propel itself as by having air plane propeller or jet engine propulsion. Whereas flying boats are known, they are more accurately described as floating airplanes. In contradistinction, this craft would primarily be a boat that flies. As such it could be flown into ports or lakes and be set up as military base stations or reconnoiter stations or for prowling and launching assaults from. As the pontoons may also be fitted with wheels or tracts In another minimum size configuration, each major part: each of the three pontoons and one deck, has the buoyancy to float itself and from about 25 to 300 pounds. That is each pontoon is made about half the size of a typical surfboard and is attached to the one deck by simple tubing. The deck is about the size of one to two surfboards and is elevated above the water surface one half to three feet.

Another configuration comprises large drum like wheels or traction treads incorporated into the pontoons which may be powered by motor and/or foot pedals and drive means such as chain drive, so that the craft may be used as an amphibious lifeguard station which can roll on a sandy beach and go directly into the surf or water and perform rescue operations.

Finally it is conceived that the apparatus herein described may also be applied as a means of connecting three or more conventional boats, whether they be all identical or different from each other, into a craft resembling the one of the primary configuration; that is a deck supported by legs on pontoons wherein the pontoons are water craft of typical boat design. In this conception three boats are connected to each other via a framework which connects the boats to one or two decks supported by the framework above the boats and the boats are held in position by the frame work relative to the decks the same as the pontoons of the primary configuration are.

Best Mode for Carrying Out the Invention

The primary embodiment of the present invention relates to a surf-boat which when assembled resembles a three legged oil well drilling platform with the exception that the legs or columns are configured so that they have a significantly wider stance than the height of the craft above the water and they have pontoons on which the entire craft is supported above the water, that is, the distance between any two pontoons, is greater than the distance from the top side of the upper platform to the water surface. As such, each pontoon acts as a fulcrum in a second class lever as the other pontoons each become effort points against which waves must push or lift in order to effect movement of the platform which is acting as a resistance in the 2nd class lever. This combination of wave permeable pontoon design and 2nd class lever configuration against the resistance of the platforms results in reduced transmission of wave motion and energy to the platform.

When in operation or used in a deployed state, the legs are spread further apart at the bottom where they connect to the pontoons than they are at the top where they connect to the upper platform, assuming the platforms are connected to each other by the legs. The pontoons may likewise be connected directly to each other rather than being connected to the craft via legs which connect the pontoons to the platforms still the wide stance and wave permeable pontoon principle would pertain to a legless configuration. The pontoons may be either ballasted or are fitted with sub surface hydro-foils or a combination of the two in order to minimize the craft's buoyancy and/or responsiveness to wave action as well as to enhance mobility performance. The craft may be motorized or not and may have an engine-well centrally located on said lower platform for added stability. The craft may be fitted with a foot pedal operated propeller and a removable semi-rigid flat weather shade which is sturdy enough to allow a 350 pound person to stand on top and use it as a diving platform and a high point observation platform. It may also be collapsed for storage. The weather shade may also be used as a stiff sail by mounting it vertically on the top of the upper deck and adjusting its orientation to wind. The crafts pontoon stance may be made contractible to allow for legal highway towing and use of typical municipal or private boat slips. This may be effected by hinging the aft pontoons to the legs and the legs to the decks so that the pontoons can swing in an arc and thereby reduce their stance or by having the spar on which the pontoons are mounted contract and thereby reduce their stance. However in this best mode the two aft legs each comprise a pair of ladders: one inboard and one out board; both oriented so that the rungs are parallel with the stem to stern centerline of the craft and/or the inboard or outboard edges of the aft pontoons. The inboard ladder is hinged near to the inboard top edge of one of the pontoons and also to the relative rear edge or corner of the lower deck. The outboard ladder similarly connects the outboard top edge of one of the pontoons to the relative rear edge or corner of the top deck. The two decks are held apart by independent vertical supports and the forward leg. The pontoons can now be swung in arcs which combine two radiuses: the outboard edges swing in an arc of a radius the length of the outboard ladder having a central point being the point at which the top of the ladder is hinged to the top deck, similarly the inboard edges of the pontoons swing in an arc having a radius defined by the length of the inboard ladder having a central point being the point at which the top of the ladder is hinged to the lower deck. There are several points at which the legs may be connected to each other via a stiff leg to fix the legs in a fully extended configuration or at some point in between fully contracted and fully extended. One good point is from the same hinge of the pontoons' inboard edge to a point near the midway point of the outboard ladder. Thus by minimally disconnecting either the inboard or the outboard points of the stiff leg the swinging aspect of the legs may be enabled. Another way of contracting the stance of the rear pontoons is to connect them to each other by a large telescoping square tube or round tube or oval or other shape tube and to support the deck on the tubes via a column which is slidably mounted to the telescoping tubes or rigidly fixed to a central portion of tubing into which slides the telescoping portion of tube which connects to the pontoons.

An enhanced water-wave shock absorbing capability of the pontoons of the craft described above would be effected by mounting the pontoons to the bottom of the columns on a ball joint and mounting shock absorbers similar to automobile shock absorbers from the pontoons to the column.

DESCRIPTION OF THE DRAWINGS

FIG. 6. Oblique view of pontoon turned upside down showing drum wheel wells and drum wheels and axle and attaching means and trailer axle attaching means.

FIG. 7. Side view of upright pontoon having drum wheels.

FIG. 8. Oblique view of a pontoon and "L" shaped leg portion which rotates as a unit.

FIG. 9. Rear detail view of expanding and collapsing aft leg and pontoon apparatus of the primary embodiment showing two different pontoons, location of push/pull air cylinders for expanding and contracting the legs and indicating the arcs of rotation of the connecting legs and the location of the stiff legs and interior anti sway bracing and deck supports.

DETAILED DESCRIPTION

Figure 1:
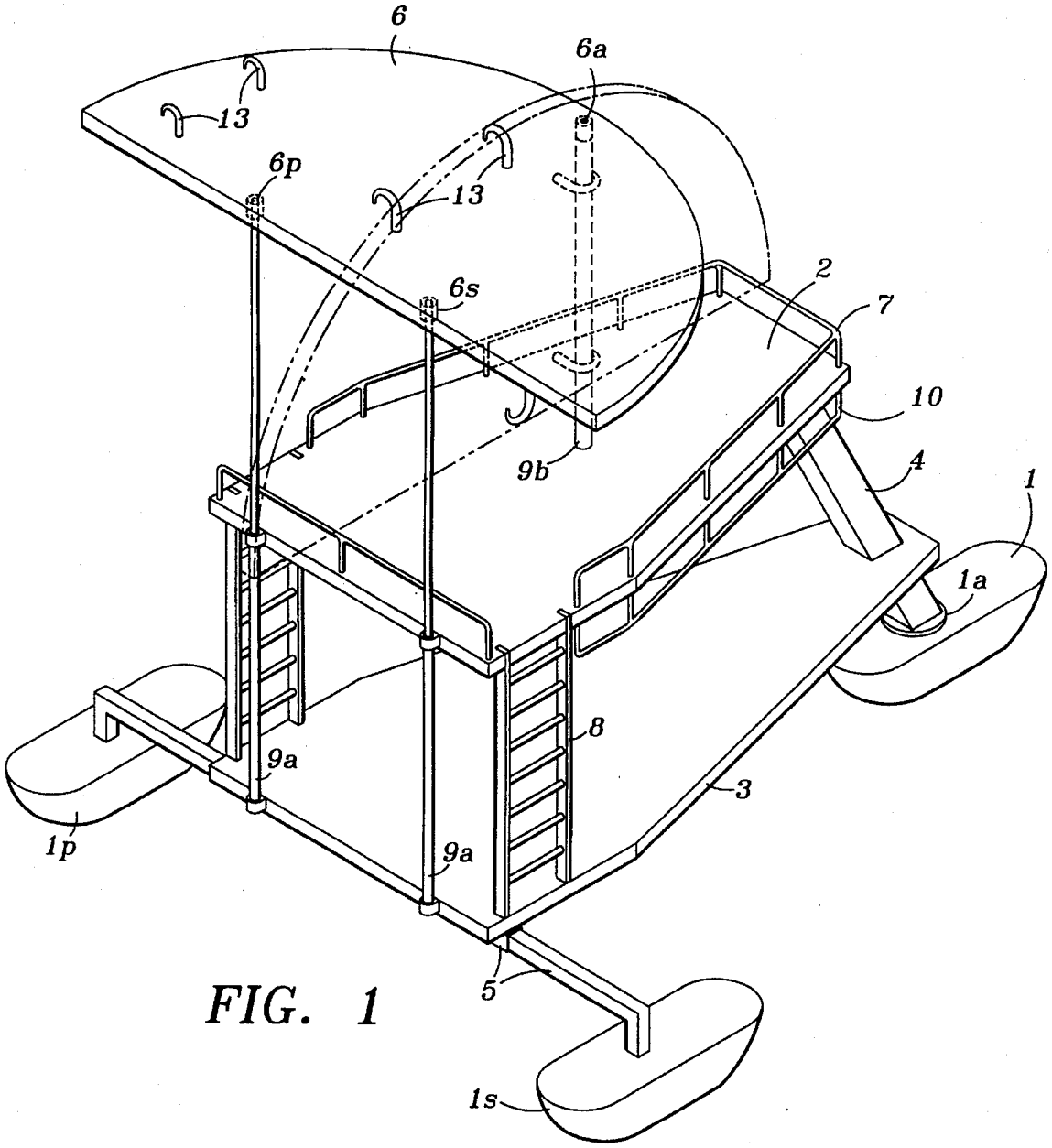
FIG. 1. Oblique view of primary embodiment of a surf-boat: a water craft designed for providing a stable observation and fishing platform in choppy waters.

This invention provides water going craft that further provides a stable platform which floats on water. In the primary configuration the craft mainly comprises two decks three pontoons and three legs or leg assemblys. Occasionally the words top and bottom are used and they are intended to refer to the uppermost or lowermost part of the referenced article as it would be situated in place on the craft when deployed. Likewise the words inward and outward indicate towards the center of the craft or away from the craft respectively. It is intended that the various figures represent features which may be interchangeably combined to create crafts not shown in the drawings but still covered by this disclosure. References to the drawings wherein several embodiments are depicted and wherein like parts may not necessarily be like numbered on different drawing figures, now commences beginning with a general orientation of several views of the primary embodiment then following with specific references and clarifications of specific details and different embodiments.

FIGS. 1, 2, 3, 5, and 19 all generally show the primary embodiment with some variations of how the pontoons are connected to the rest of the craft, how the craft is propelled and how the decks are related to each other and the pontoons. The rest of the figures disclose details or alternate embodiments.

Beginning with FIG. 1, a tripod pontoon is shown. A forward pontoon 1 is rigidly connected to a spacer 1*a* which is pivotally mounted to the bottom of the forward leg 4, which is generally made of a square hollow tube. The forward pontoon can be pivoted in a horizontal plane in order to steer the craft as it moves in a body of water. The two other pontoons 1*s* and 1*p*, are the aft portion of the craft. Disposed between all of the pontoons and connected to the forward leg approximately midway up the leg is the lower deck 3. The aft portion of the deck rests upon a telescoping square tube assembly 5. This assembly is of primary importance to this invention because it allows the aft pontoons to have their stance relative to the width of the craft altered. In a contracted state the craft can be fit into boat slips and onto trailers easily. While still able to float and move in water the craft would have a high center of gravity and be unstable in water with the pontoons stance contracted. In an expanded state the craft when deployed in water has an increased stability over conventional boats and its center of gravity is lowered. An upper deck 2 is connected to the top of the forward leg 4 and spans rearward to connect to a ladder 8 and deck supports 9*a* and 9*a*. The ladder and deck supports are the supporting structure which hold the upper deck above the lower deck by being fastened between the two decks. A handrail 7 fastened to the top of the upper deck and another 10 fastened below the upper deck serve to provide hand holds for people on either deck. A shade 6 is supported above the upper deck by telescoping extension poles 9 which telescope into the deck supports 9 and 9*a* and fit into blind slots in the shades underside 6*a*, 6*s* and 6*p*, and by a telescoping mast/pole 9*b*. The shade is generally a hollow rigid board which can support one person standing on the shade. The shade has a pair of mast cleats 13 which are "J" shaped aligned hooks that can be snap fitted, facing the open hook part of the "J" forward, around the mast/pole when the shade is used as a sail. There may be a plurality of these cleat pairs above and below the sail which may have other utilitarian uses such as lantern and water jug holding hooks or clothes drying hooks and alternate sail positioning cleats. In general the overall dimensions of a three person craft would be 8½ feet wide with legs contracted, 16 feet wide with legs expanded, 7½ feet from top of upper deck to bottom of pontoons, 5 feet between decks and 20 feet from the rear of the aft pontoons to the front of the forward pontoon.

Figure 3:
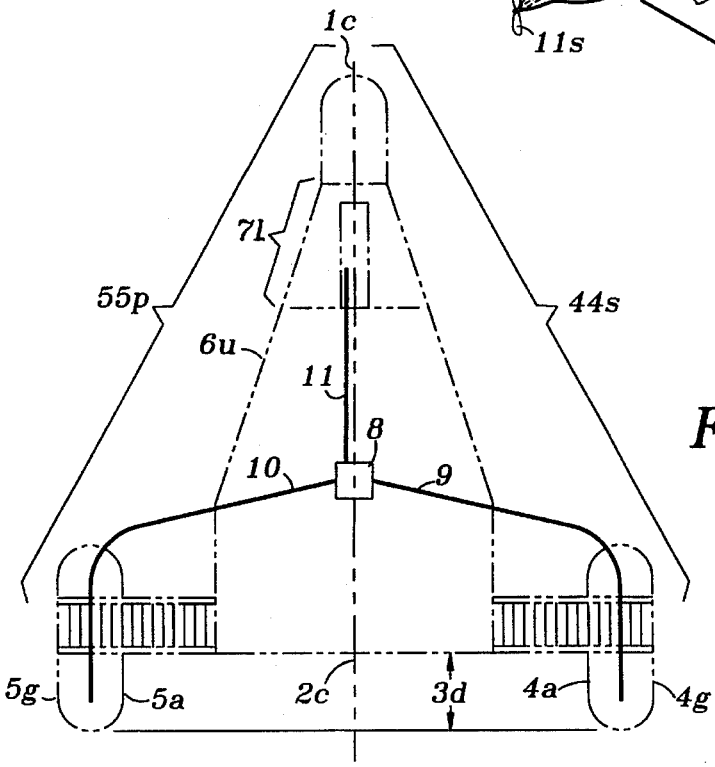
FIG. 3. Plan view orientation of primary embodiment.

Referring to FIG. 3, there is shown a plan view of the primary embodiment having a centerline drawn from the forward most part of the craft 1*c* to the rearward or aft part of the craft 2*c*. It should be noted that the deck(s) are not the rearward most part of the craft as the pontoons protrude farther to the rear than the aft most part of the decks do as indicated by reference 3. Viewing a two deck craft from above would indicate that the forward most part of the lower deck 71 protrudes further forward than the forward most part of the upper deck 6*u*. Everything relatively to the left of the centerline 1*c* is generally herein referred to as being on the port side 55*p* e.g. the inboard and outboard edges of the aft port pontoon are indicated by the reference numbers 5*a* and 5*g* respectively. Everything relatively to the right of the centerline 1 is generally herein referred to as being on the starboard side 44*s* e.g. the inboard and outboard edges of the aft starboard pontoon are indicated by the reference numbers 4*a* and 4*g* respectively.

Figure 2:
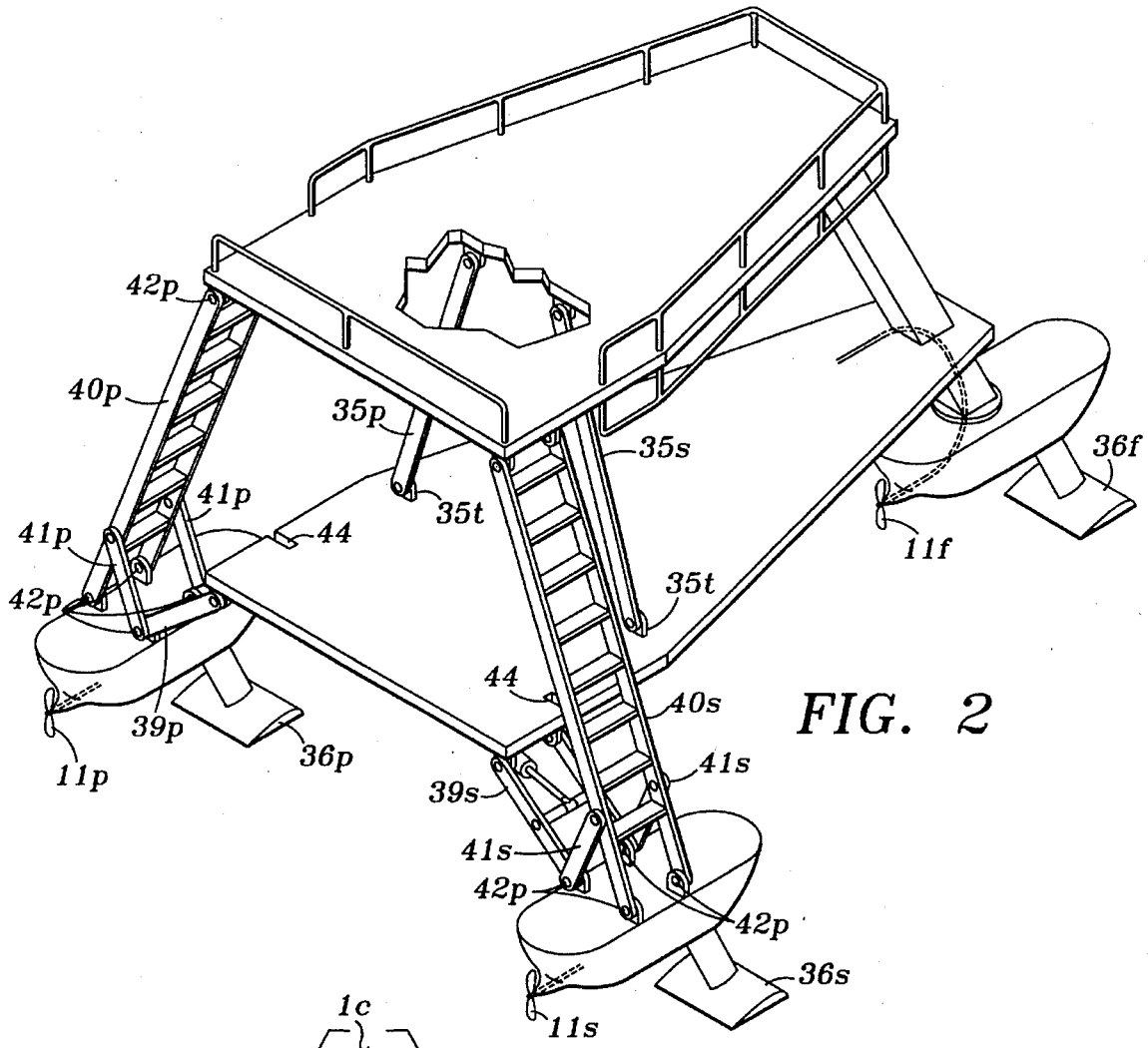
FIG. 2. Oblique view of primary embodiment showing additional or alternate features: hydrofoils, anti sway bracing, air tank, ship to ship lower deck docking plank.

Referring to FIG. 2 there is shown again the basic primary embodiment with a section of the top deck 2*u* cut away to reveal the location of anti-sway braces 35*s* and 35*p* which are basically an "A" frame structure composed of material strong enough to support the upper deck should the deck supports fail, disposed between the two decks near the rear portion of the craft and connected at their bottoms to the lower deck 21 at deck tabs 35*t* and 35*t*. An interesting feature depicted in this view is the use of hydro-foils 36*f*, 36*s* and 36*p* mounted beneath the pontoons. These would be used with high performance motors and/or specially designed articulators which would regulate the pontoons level out of the water by regulating the pitch of the hydro-foils. FIG. 2 also shows what is subjectively considered to be the best mode of deploying the aft pontoons by the use of outboard ladder legs 40*s* and 40*p* and inboard ladder legs 39*s* and 39*p* and stiffening bars 41*s* and 41*p*. The legs all swing on pivot points 42*s* and 42*p* where they connect to either the decks or the pontoons.

This is analogous to a typical folding ladder which has two legs, one leg has rungs and a pair of side stringers and the other usually has a criss cross brace and a paint can support surface and a top step (equivalent to the pontoons) to which are pivotally connected both legs. Considering that the points where the folding ladder legs touch two different stair steps are hinge points, (equivalent to the two decks hinge points) the ladder may be swayed back and forth when the legs are only partially opened. When the knee joint typical to such ladders is stiffened or locked fully extended the ladder becomes unable to sway back and forth. This is how the legs and pontoons and stiffening legs operate on the herein described craft.

Figure 12:
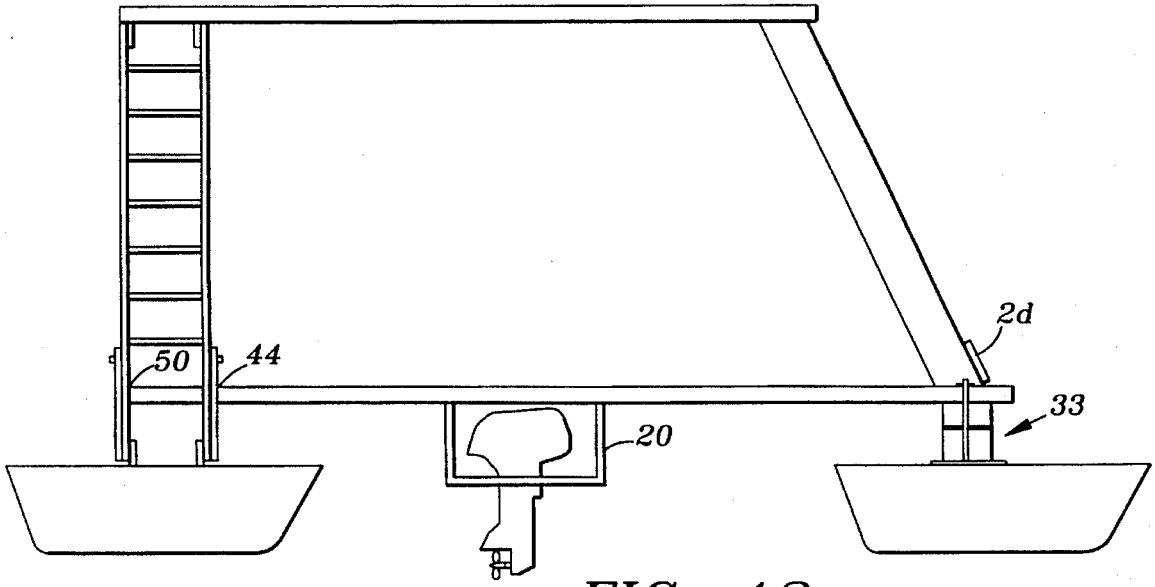
FIG. 12. Side view of primary embodiment also showing possible location of engine well for out board motor.
Figure 18:
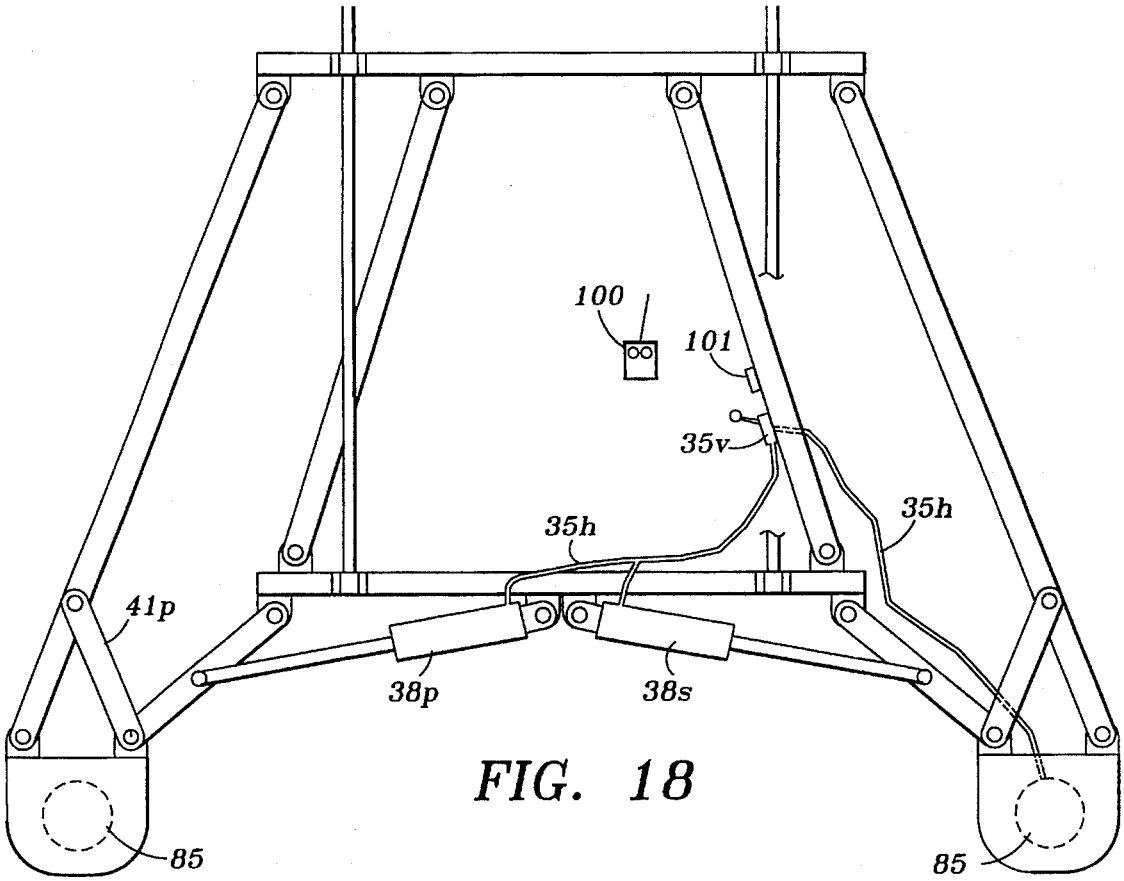
FIG. 18. Rear view of aft area of primary embodiment indicating placement of air cylinders and air hose routing and anti sway bracing and deck supports.

This swinging or rotating of the legs and attached pontoons can be done manually or with the assistance of hydraulic or pneumatic cylinders and valve controls 38*s*, and 38*p*, 35*v*, *h* and 85, as shown in FIG. 18 . Nearly all of the connections between legs or bars and decks or pontoons are by means of a tab which is mounted to the pivoting piece by bolt or pins so as to allow the rotation of the leg strut or bar to freely rotate without binding on the deck or pontoon surface nearest the connecting leg or strut or brace or bar. Once swung out to a fully extended position the stiffening bars are swung into engagement with a lock peg on the outboard ladder leg 41*s* and 41*p*, also shown with the same reference numbers in FIGS. 10, connecting the the inboard pontoon pivot point to a point approximately midway of the outboard ladder leg. This lock peg resembles a half inch galvanized domestic plumbing pipe nipple with a cap on the exposed end sticking out of the sides of the ladder leg. Respectively there are at least eight such pivot points when considered individually on each the port and starboard sides being four on each outboard ladder leg and four on each inboard ladder leg. Referring briefly to FIG. 12. When the legs contract, by minimally disconnecting either the inboard or the outboard points of the stiff leg the swinging aspect of the legs may be enabled, then by swinging or rotating on their pivot points the outboard ladder tucks behind the decks rear edge 50 and into the slot 44. 44 refers to the same slot in FIG. 2. When the legs are thus contracted the craft will tilt in the water because the aft legs are now pointing directly downward instead of at a combined downward and outboard angle. This results in the aft end of the craft being buoyed upward while the forward pontoon has remained in its original position. Referring back now to FIG. 3 a schematic symbol for an engine is shown at 8 which drives torsion cables 9, 10 and 11 which in turn drive propellers 11*f*, 11*s* and 11*p* as shown in FIG. 2.

Figure 4:
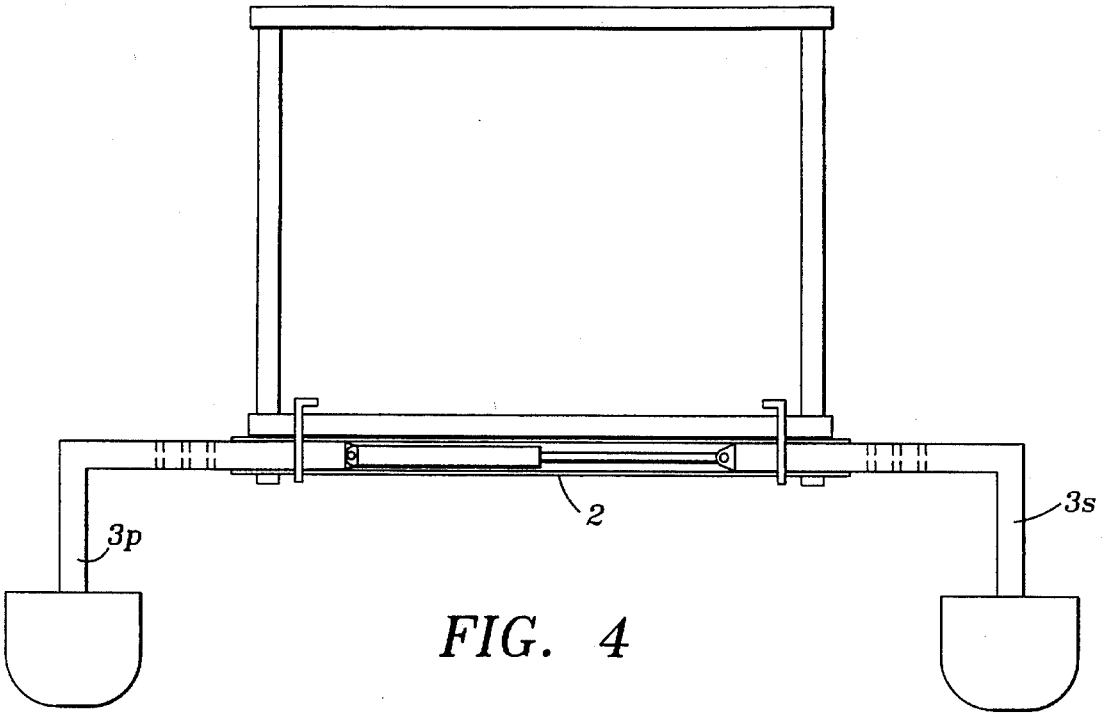
FIG. 4. End view of a bi-telescoping aft leg pontoon, expanding and contracting, connecting means.

FIG. 4 is an end view of a hi-telescoping aft leg pontoon, expanding and contracting, connecting means. That is, a central horizontal hollow chamber 2 either square rectangular or round in cross section is connected directly to the decks and two mating but opposite telescoping legs 3*s* and 3*p* extend and contract to effect the dynamic ability of the craft. The advantage of these telescoping designs is that there is no tilting of the craft when the pontoons are contracted.

An air or hydraulic cylinder 38*p* and 38*s* as shown in FIG. 18 may be used to deploy and contract the legs of all the crafts shown.

Figure 5:
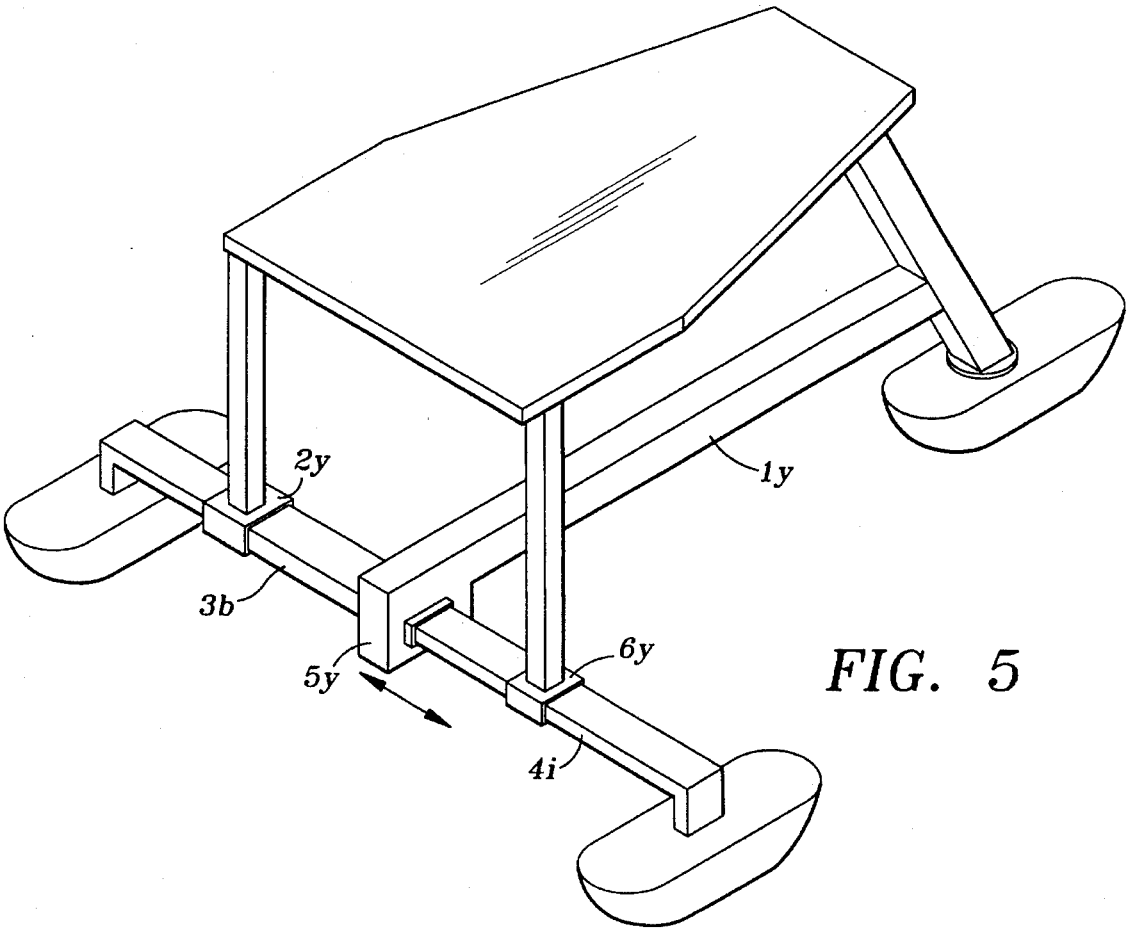
FIG. 5. Oblique view of mono-telescoping aft leg and pontoon expanding and contracting means, showing construction having no lower deck in place but having lower framework in place.

FIG. 5 is an oblique view of mono-telescoping aft leg and pontoon expanding and contracting means being an outer telescoping tube 3*b* and an inner telescoping tube 4*i*. The monotelescope is connected to the deck by slidable yoke columns 2*y* and 6*y*, and to the front leg brace 5*y*. This craft illustration showing construction having no lower deck in place but having a front leg brace/lower framework in place 1*y* which is necessary to support the legs from the stress that would result at the leg mounting on the upper deck were the framework not in place.

FIG. 6 is an oblique view of a pontoon turned upside down showing drum wheel wells 1*w* and 1*x* and drum wheels 2*w* and 2*x* and axles 3*w* and 3*x* and attaching means such as clip and socket 4*w* and trailer axle attaching means such as a grove or channel 5*w* built into the pontoon.

FIG. 7 is a side view of upright pontoon having drum wheels.

FIG. 8 is an oblique view of a unitized pontoon and "L" shaped leg portion 31 which rotate as a unit inwardly and outwardly on a vertical axis 21.

FIG. 9 is a rear detail view of expanding and collapsing aft ladder leg and pontoon apparatus of the primary embodiment showing two different style pontoons 1*p* and 1*s*, location of push/pull air cylinders 38*p* and 38*s*, for expanding and contracting the legs and indicating the arcs of rotation 1R and 2R, of the connecting legs and the location of the stiffening bars 41*s* and 41*p*, and interior anti sway bracing 35*s* and 35*p*, and deck supports 36*s* and 36*p*. Hidden lines indicate the approximate result of contracting the legs through the arcs of rotation. The stiffening bars, like the legs rotate on pivot points 42*s* and 42*p*. A locking stud 60 holds the pontoons together when the legs are contracted.

Figure 10:
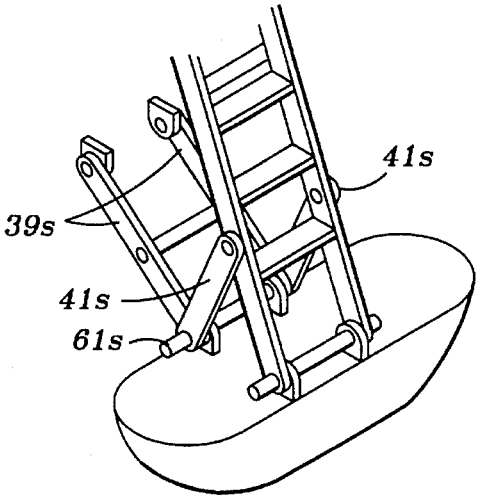
FIG. 10. Oblique view of connecting leg pontoon hinge points and use of single pin to connect several points at once.
Figure 11:
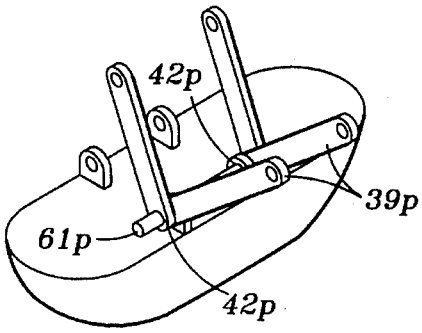
FIG. 11. Oblique view of connecting leg pontoon hinge points and use of single pin to connect several parts and hinge points at once.

To operate the contracting and expanding apparatus described herein, beginning with a contracted leg situation with the craft in the water preferably, one would first remove the locking stud 60 from the hinge pins extended ends 61*s* and 61*p* as shown in FIGS. 10 and 11. This stud is held in place by a cotterpin or safety pin. The hinge pin extended ends should have a cap larger than the latch opening for the stud to not fall off when attached thereto. Once the locking stud is removed the legs can be spread apart by hand or by supplying compressed air or hydraulic fluid to expand the cylinders 38*p* and 38*s* as shown in FIGS. 9 and 18. As the legs rotate outwards the stiffening bar or bars are engaged to the outboard ladder leg lock peg or pegs and the craft is now fully deployed; save for raising the shade and starting the motors if any. To contract the legs the opposite procedure is followed and the cylinders are operated to contract themselves if contraction is not manually operated.

FIG. 10 is an oblique view of connecting leg pontoon hinge points and use of single pins 61*s* to connect several parts: the stiffening bar 41*s*, the inboard ladder 39*s*, and hinge points of the pontoon inboard 42*s* at once.

FIG. 11 is an oblique view of connecting leg pontoon hinge points and use of single pin 61*p*, to connect several points at once.

FIG. 12 is a side view of primary embodiment also showing possible location of engine well 20 for out board motor or 12 volt batteries and a detail view of a service door 2*d* in the front of the forward leg. A simplified steering pivot mechanism 33 is also shown.

Figure 13:
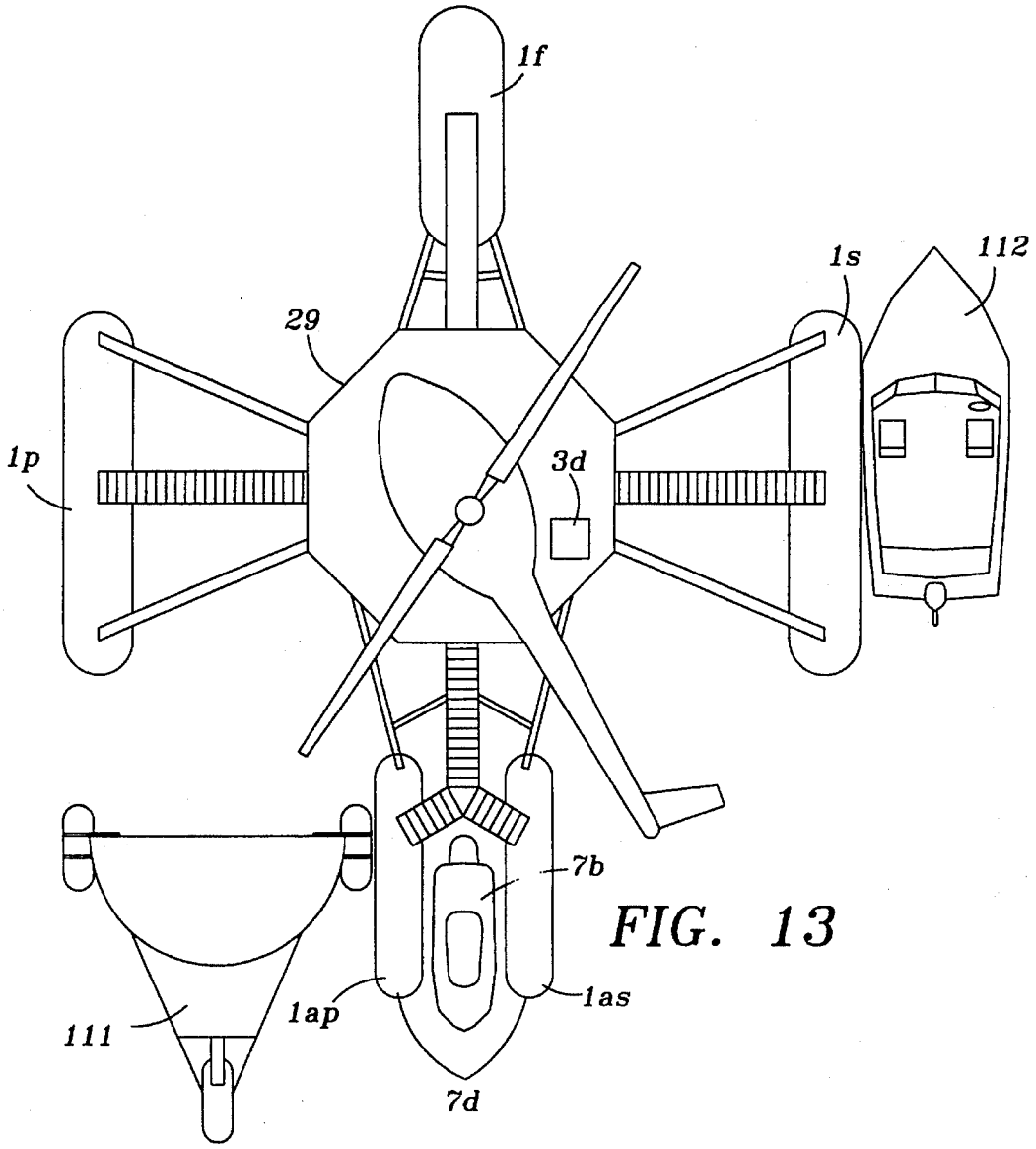
FIG. 13. A plan view of an alternate embodiment of a surf boat utilizing anti wave response extended pontoons and deck principle to provide stable helicopter hexagonal landing pad and boat dock, comprising four legs five pontoons and a hexagonal deck.
Figure 14:
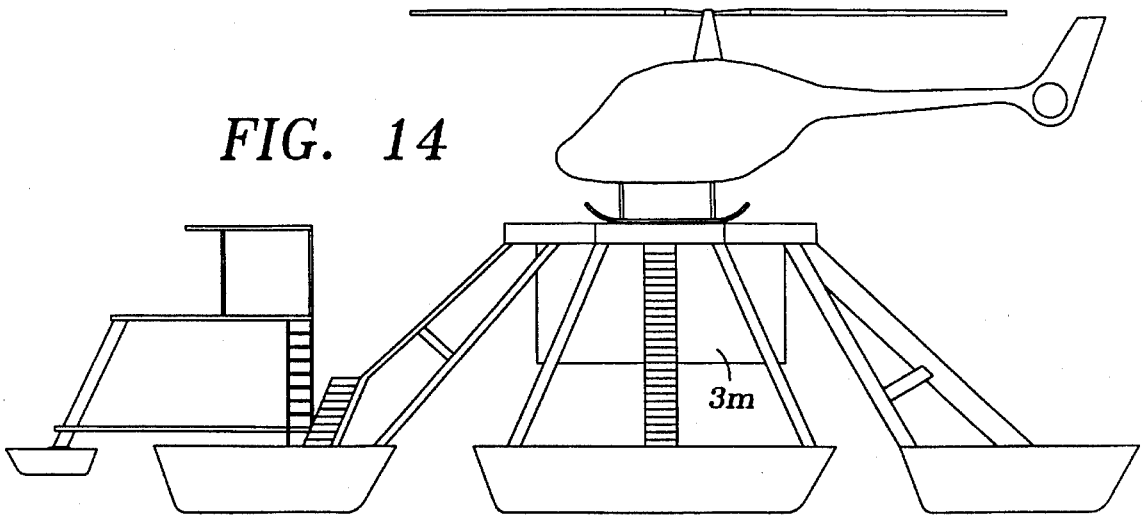
FIG. 14. A side view of the alternate embodiment of a surf boat shown in FIG. 13, utilizing anti wave response extended pontoon and deck principle to provide stable helicopter landing pad and boat dock.

FIG. 13 is a schematic plan view of the alternate embodiment of a surf boat shown in FIG. 14, utilizing anti wave response extended pontoon and deck principle to provide stable helicopter landing pad 29 and a boat dock 7*d*. Five pontoons, 1*f*, 1*p*, 1*s*, 1*ap*, and 1*as*, are laid out all oriented in the same direction. 1*f* would be the forward or steering pontoon. 1*s* and 1*p* would be starboard and port pontoons. 1*ap* and 1*as* would be side by side rear pontoons spaced apart to act as a surrounding dock for a small boat 7*b*. This craft could be used as a home base in high seas surveillance of drug trafficking or pollution of waters or illegal fishing. Crafts of the primary embodiment 111, could dock to the pontoons as could regular craft 112. A trap door 3*d* leads below deck to a personnel quartering chamber.

FIG. 14 is a side view of an alternate embodiment of a surf boat utilizing anti wave response extended pontoons and deck principle to provide stable helicopter hexagonal landing pad and boat dock, comprising four legs five pontoons and a hexagonal deck. A personnel quartering chamber is indicated 3*m* which would provide typical room and board facilities.

Figure 15:
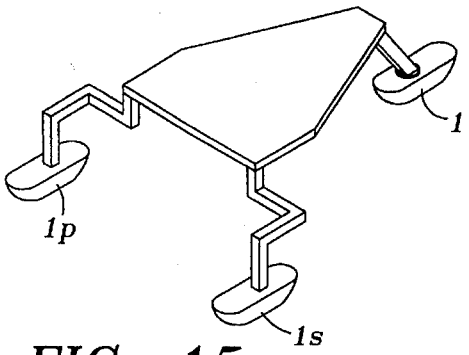
FIG. 15. An oblique view of an alternate embodiment showing a raft style single deck and tripod pontoon arrangement wherein the pontoons are completely outside of the exterior dimensions of the deck.
Figure 16:
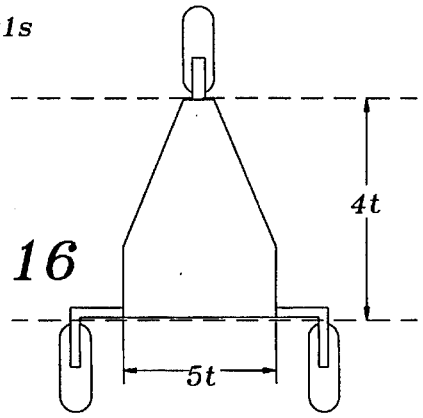
FIG. 16. A plan view of an alternate embodiment showing a raft style single deck and tripod pontoon arrangement wherein the pontoons are completely outside of the exterior dimensions of the deck, as shown in FIG. 15.

FIG. 15 is an oblique view of an alternate embodiment showing a raft style single deck and tripod pontoon arrangement wherein the pontoons 1, 1*p* and 1*s* are completely outside of the exterior dimensions 4*t* and 5*t* as shown in FIG. 16, of the deck.

FIG. 16 is a plan view of an alternate embodiment showing a raft style single deck and tripod pontoon arrangement wherein the pontoons are completely outside of the exterior dimensions of the deck, as shown in FIG. 15.

Figure 17:
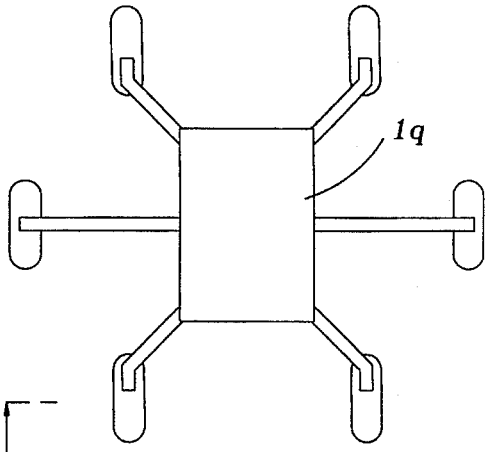
FIG. 17. A plan view of a hexapod having a square deck having the qualities of the embodiment shown in FIGS. 13 and 14 and/or of the primary embodiment.

FIG. 17 is a plan view of a hexapod having a square deck 1*q* generally having the qualities of the embodiment shown in FIGS. 13 and 14 and/or of the primary embodiments.

FIG. 18 is a rear view of aft area of primary embodiment indicating placement of air cylinders and air hose routing and anti sway bracing and deck supports. The connecting pivot points and tabs have previously been described. The air valve 35*v* may be located where shown or may be removable and relocatable or operated by electronic remote control 100 and receiver/servo 101. Air tanks 85 and 85 may be used to control ballast and assist steering.

Figure 19:
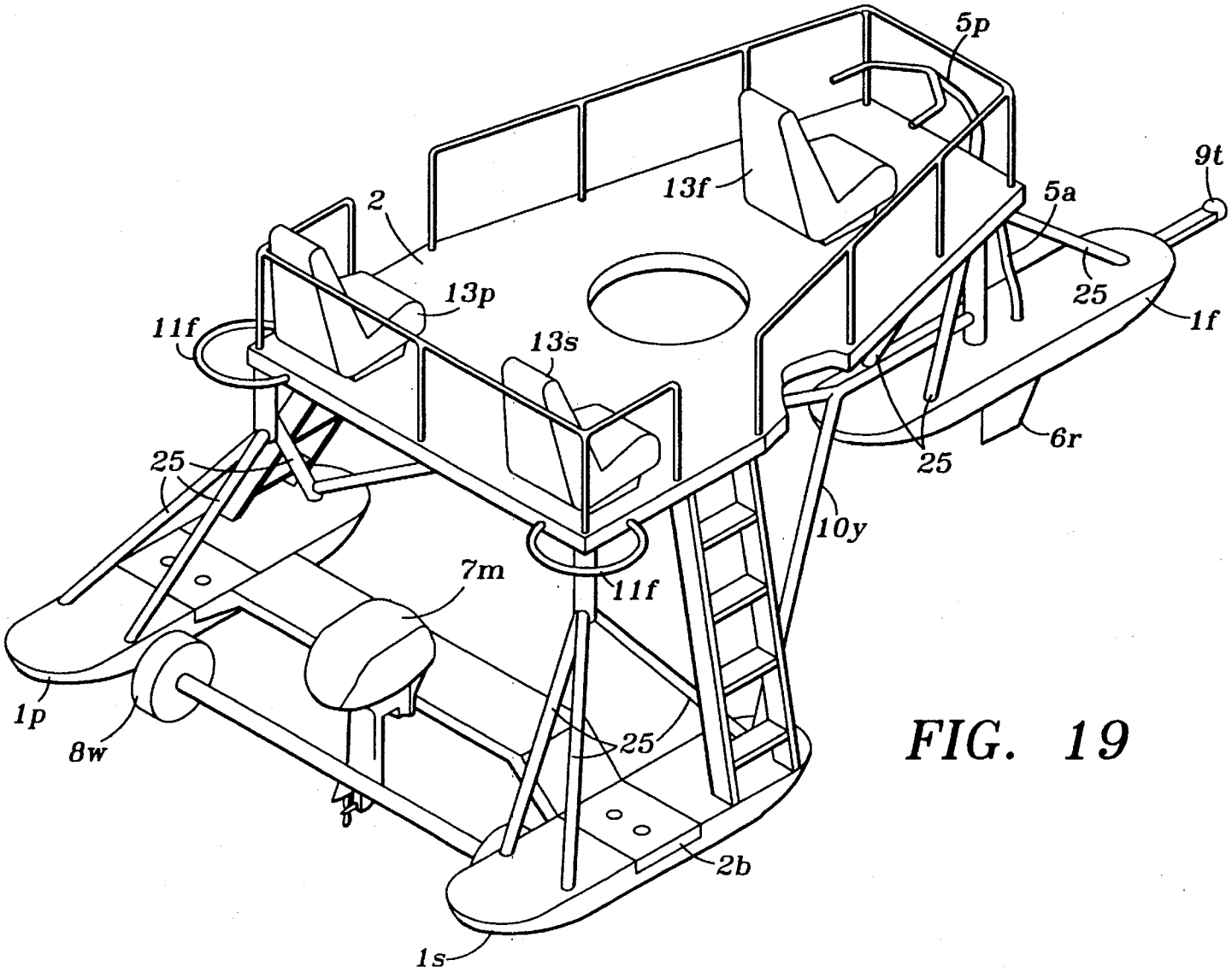
FIG. 19. An oblique view of a three person one deck surf boat.

FIG. 19 is an oblique view of a three person, one deck, fixed aft pontoons surf boat. This configuration comprises a deck 2, three pontoons 1*f*, 1*s* and 1*p*, being about twice approximate thickness but having similar shape of surf boards. Each corner of the deck is supported by a tripod frame 25 connecting to the pontoon's top surface. The deck has a handrail 7 around its perimeter. The aft pontoons are fixed to each other by a beam 2*b* which also supports an outboard motor 7*m*. A removable axle and wheel assembly 8*w* may be fitted to the underside of the aft pontoons. The front of the forward pontoon has a trailer tongue 9*t* permanently fixed to it. Steering is effected by turning a handlebar 5*p* which is connected by flexible shaft means 5*a* to a rudder 6*r* under the forward pontoon.

A "Y" frame 10*y* reinforces the lower part of the forward pontoon leg frame by connecting it to the aft legs. Foot rests 11*f* at the aft corners provide maximum distance between seats 13*f*, 13*s* and 13*p*'s utility. The pontoons are about 5 inches thick and 2 feet wide and six feet long and the overall length of the craft is 16 feet and the aft pontoons are 8 feet apart at their outsides and the deck is about 5 feet above the top of the pontoons. The deck dimension is six feet wide by ten feet long.

I claim:

1. A water going craft comprising:

(a) two generally triangular planer decks, being a lower deck, and an upper deck, each which have: top and under sides, leading and rear, port and starboard, sides and edges and leading and rear ends all respectively of an imaginary stem to stern centerline which extends from the center of the forward most part of the deck through the center of said rear edge of the decks being the rearward most part of the deck and an imaginary cross centerline which perpendicularly intersects and bisects the stem to stern centerline exactly midway between the front and rear ends of the decks and passes through the port and starboard edges of the decks the, said port and starboard sides of the craft being the portions of the craft to the left and right of said stem to stern centerline respectively, and wherein said triangular shaped decks are foreshortened whereby a flat front edge is created to be perpendicular to said stem to stern center line and port and starboard flat edges are created parallel to said stem to stern centerline;

(b) a first forward and a second and third port and starboard pontoons respectively wherein said pontoons have a top, top central area, bottom, rear edge, inboard side, and outboard side, inboard top edge, outboard top edge, wherein said inboard and outboard references relate to the deck so that an "inboard" reference refers to a pontoon side or edge or place closest to the deck's stem to stern centerline ,except for said forward pontoon wherein left and right designate inboard and outboard respectively; and (c) five legs, each having relative length, width, tops, bottoms and midway points between the tops and bottoms, they are; one forward leg comprising a hollow column and four aft legs; said four aft legs, comprise a port pair of legs and a starboard pair of legs; each pair comprises one inboard leg and one outboard leg, said inboard legs being approximately half the length of said outboard legs; and (d) one each port and starboard supporting struts; further comprising top and bottom ends, said struts are rigidly mounted to the rear edge of both said decks at a point between said decks' stem to stern centerline and extending from one to the other near the rear ends of said upper and lower decks respectively at or near said port and starboard flat edges, whereby when so mounted they support and hold the two decks apart; and (e) port and starboard stiff bars comprised each of a pair of stiffening bars, said port and starboard stiff bars each are used to stiffen and hold the pontoons at an outwardly extended position by being attached adjacent to the inboard leg bottom pontoon inboard edge attaching point and to a pivot point on said outboard leg between said outboard leg's midway point and its bottom, said decks each further comprise three leg mounting areas: a forward leg mounting area, a port aft leg mounting area and a starboard aft leg mounting area, wherein further the each of the aft said mounting areas and said forward edge have means for attaching said forward leg to said forward leg mounting area, and means for connecting the top of said outboard legs to said underside of said upper deck aft leg mounting areas and said inboard legs to said underside of said lower deck aft leg mounting areas; and said upper deck leading end is attached to said forward leg between its midway point and the top of said forward leg and said said upper deck underside port and starboard aft mounting areas of said upper deck underside are attached to the tops of said outboard legs; and said lower deck is attached to said forward leg at a point on said forward leg from said forward leg's midway point to its bottom and said lower deck's aft leg mounting areas are attached to the tops of said inboard legs;

said bottom of said forward leg is pivotally attached to the top central area of said forward pontoon, whereby said forward pontoon is steerable in a horizontal plane; and said starboard outboard leg bottom is mounted near said outboard top edge of said starboard pontoon; and said starboard inboard leg top being attached to said lower deck; said starboard inboard leg bottom is mounted near said inboard top edge of said starboard pontoon;

said port aft leg mounting areas of said upper and lower decks are attached to the remaining said port inboard and port outboard legs and the port pontoon in a mirror image of said starboard aft leg mounting areas to said starboard pontoons via said inboard and outboard legs.

2. The water going craft of claim 1, further comprising a top shade, wherein the decks are from one sixteenth inch to ten inches thick further having bracing and reinforcing bars and struts which struts further are two anti sway braces; further comprising tops and bottoms, said anti-sway braces which are basically an A frame structure composed of material strong enough to support the upper deck should the said support struts fail, disposed between the two decks near the rear portion of the craft and connected at their bottoms to the lower deck and at their tops to the underside of the upper deck one on either side of said stem to stern centerline.

3. The water going craft of claim 2, wherein said shade is light weight and may be repositioned to be used as a sail for emergency propulsion.

4. The water going craft of claim 2, wherein the decks, pontoons, legs, bars and shade are made of one or more of the following materials: aluminum, iron, wood, steel, metal alloys, corrosion resistant metal alloys, plastic reinforced fiberglass, plastic, plastic reinforced carbon fiber, rubber, rubber tubing, zinc coated iron, copper, or brass.

5. The water going craft of claim 1, wherein all of said pontoons are fitted with wheels.

6. The water going craft of claim 1, wherein said aft pontoons are connected to each other by telescoping means wherein further said telescoping means comprises a centrally located external telescoping section and the aft pontoons are each connected to an internal telescoping section which fit into said external telescoping section and said lower deck is mounted directly and rigidly to said external telescoping section and said pontoons may be telescoped in and out and wherein said telescoping means also comprises drop pin means for temporarily securing said pontoons in a telescoped position, said drop pin means further comprises a plurality of holes which align to allow said drop pin to be inserted thereby effecting securing the pontoons in a desired position.

7. A water going helicopter landing pad comprising;

(a) one 20 to 60 foot diameter landing pad deck; further comprising a top side and an underside, a living quarter, suspended from the underside of said deck, whereby said quarter may be entered from above deck hatch door means; and (b) a supporting undercarriage; further comprising four main legs: one forward, one port, one starboard and one forked rear aft leg which angle downward and away from said deck at a descending angle of from about 15 to 45 degrees and each have step or ladder rung climbing means; and (c) 5 elongated pontoons, one forward, one port, one starboard and two aft, each having top and bottom sides, a top central area and a forward or front end and a rear end and each has port and starboard sides;

wherein said legs are rigidly attached to the undercarriage supporting the deck and the living quarters and attach to the top central portions of the pontoons;

wherein further said pontoons are oriented facing the same direction and said forward pontoon has steering means and said two aft pontoons are held in parallel relationship to each other by said forked aft leg, spaced apart so as to create a small boat slip and boat docking means whereby a boat may be used to push said craft in the water by engaging itself into said slip.

* * * * *